United States Patent [19]

Wuelfing, Jr.

[11] Patent Number: 4,741,991

[45] Date of Patent: May 3, 1988

[54] STABLE PHOTOGRAPHIC DEVELOPER AND REPLENISHER THEREFOR

[75] Inventor: Peter Wuelfing, Jr., Arden, N.C.

[73] Assignee: E. I. Du Pont de Nemours and Company, Wilmington, Del.

[21] Appl. No.: 851,920

[22] Filed: Apr. 14, 1986

Related U.S. Application Data

[63] Continuation of Ser. No. 439,568, Nov. 5, 1982, abandoned, which is a continuation-in-part of Ser. No. 286,331, Jul. 23, 1981, abandoned.

[51] Int. Cl.[4] ..... G03C 5/26

[52] U.S. Cl. ..... 430/399; 430/481; 430/966

[58] Field of Search ..... 430/399, 481

[56] References Cited

U.S. PATENT DOCUMENTS

| | | | |
|---|---|---|---|
| 3,545,971 | 12/1970 | Barnes et al. | 96/61 |
| 4,029,510 | 6/1977 | Speets | 96/61 |
| 4,046,571 | 9/1977 | Mertz | 430/399 |
| 4,081,280 | 3/1978 | Corluy et al. | 430/399 |
| 4,228,234 | 10/1980 | Okutsu et al. | 430/399 |

FOREIGN PATENT DOCUMENTS 805096 1/1969 Canada .

OTHER PUBLICATIONS

Evans, R. M., "Maintenance of a Developer by Continuous Replenishment", 31, *J.S.M.P.E.*, 273–286, (Sep. 1938).

*Primary Examiner*—Richard L. Schilling

[57] ABSTRACT

An aqueous photographic silver halide developer/replenisher solution particularly useful in low throughput machine processing of X-ray silver halide elements.

8 Claims, No Drawings

STABLE PHOTOGRAPHIC DEVELOPER AND REPLENISHER THEREFOR

CROSS REFERENCE TO RELATED APPLICATION

This application is a continuation of Ser. No. 439,568, filed Nov. 5, 1982, now abandoned, which is a continuation in part of Ser. No. 286,331, filed July 23, 1981, now abandoned.

TECHNICAL FIELD

This invention is in the field of photographic silver halide developer solutions and replenishers therefor, and is specifically directed to developer-replenisher solutions useful in low through-put machine processing (developing) of photographic film.

BACKGROUND ART

The use of so-called "automatic processors" is conventional for developing imagewise exposed silver halide elements such as X-ray films. The exposed films are fed into the processor from a safelight area, i.e. one in which the level of light is reduced below that which exposes the film further, and is transported through various chambers containing the developer, the fixer and the water washes. At the end of the processor, the film is dried and exits into normal light as a finished product ready for use. This is illustrated in U.S. Pat. No. 3,545,971 "Rapid Processing of Photographic X-ray Film" (1966). This system is rapid and convenient and large numbers of films can be routinely handled in this manner over long periods of time without deleterious effects to the finished image. Of course, the processing solutions become exhausted by the passage of the exposed silver halide film and replenishment must be made to account for ingredient loss. Additionally, the processing fluids, especially the developer solution, are degraded aerobically by contact with air and anerobically when simply left for long periods of inaction.

When large amounts of film are being processed (high throughput), exhaustion of the developer is due almost entirely to development of the silver halide image. The development reaction as shown in Mason's "Photographic Processing Chemistry" Focal Press (1966) page 74, is:

$$2AgBr + H_2Q + Na_2SO_3 \rightarrow 2Ag + HBr + NaBr + HQSO_3Na$$

Thus, some materials, i.e., hydroquinone and sulfite are lost while bromide, acid, and hydroquinone monosulfonate are formed. Also, not shown by this reaction, antifoggant may be lost. Current developer replenishers are formulated based on this reaction as follows: The replenisher is made higher in pH than developer and contains no bromide, so as to offset the acid and bromide released by the development reaction. The other ingredients are set at concentrations which allow for the expected losses, the hydroquinone being offset by the antifoggants, without substantially affecting the sensitometry. In this situation a replenishment rate can be conveniently calculated based on the approximate area of film fed into the processor.

The other situation presents a more difficult problem because when only small amounts of film are processed (low throughput), the developer deteriorates primarily from air oxidation and thermal reaction, and not from development reaction; Mason's "Photographic Processing Chemistry" supra at page 73:

$$H_2Q + 2Na_2SO_3 + O_2 \rightarrow HQSO_3Na + NaOH + Na_2SO_4.$$

That is, hydroquinone and sulfite are lost but not bromide. Also, pH increases, not decreases as in the development reaction. Also, since film passage activates the replenishment, low throughput decreases replenishment.

Current practice is to compensate for low throughput by increasing replenishment rate significantly, e.g., as much as two-fold. This, however, can actually accelerate the problems caused by low throughput processing and cause sensitometric instability. It does so because the replenisher, which is being added, in excess, has higher pH than the developer and no bromide. The effect of this is to (1) maintain the increasing pH of the developer caused by oxidation, and (2) dilute the bromide content to levels so low as to cause sensitometric instability, reflected mainly in fog and speed.

The present invention provides a replenisher formulation which is aimed at compensating for developer changes caused by nonuse, and not by the development reaction. Thus, the replenisher is characterized by a pH lower than that of the developer, and it contains the maximum amount of bromide consistent with acceptable sensitometry and contains enough antifoggant to minimize loss during use. Now when replenishment occurs, pH will remain constant or slightly decrease, the bromide will remain essentially constant, and the other changes will compensate as in state of the art formulations. That is, the developer hydroquinone, sulfite, and antifoggant losses suffered during periods of nonuse are not sufficiently great to cause sensitometric instability. Before this occurs replenishment occurs, restoring these ingredients to concentrations closer to their initial values. Thus, by maintaining the developer composition more constant, the developer can maintain a useful lifetime equivalent to the high throughput processors. Because of the optimal developer/replenisher balance for low throughput, the developer is stabilized with less replenishment than the conventional developers when attempting to process these same low throughput conditions.

It is accordingly an object of this invention to provide an improved developer/replenisher system for developing exposed silver halide photographic film. A further object is to provide a developer/replenisher system particularly useful for machine processing of X-ray film when low throughput of film is practised.

SUMMARY OF THE INVENTION

These and other objects are achieved in this invention by providing an aqueous processing solution useful as a photographic developer bath for automatic low throughput processing of silver halide photographic film, particularly X-ray film, and as a replenisher therefor, consisting essentially of, per liter:

| | |
|---|---|
| 1-phenyl-3-pyrazolidone photographic developing agent, or a derivative thereof | 0.8 to 2.5 g |
| Hydroquinone developing agent or a derivative thereof | 15 to 35 g |
| Bromide ion | 1 to 7 g |
| Organic antifoggant and film speed restrainer | 0.01 to 6.0 mmole |

-continued

| |
|---|
| Alkaline material and buffer to provide a pH of 10.0 ± 0.3; |

with the proviso that the replenisher solution will not only contain bromide ion but also will have a lower pH than that of the developer solution.

Developers and replenishers made according to this invention can be used in processing machines for low throughput of X-ray film, for example, and will exhibit excellent stability over long periods of both use and nonuse. This is very surprising because prior art formulations have been known to last only a few weeks when practicing low throughput. It can be seen in Example 2 of this specification that the preferred embodiment of this invention lasted more than ten months under actual low throughput conditions in a hospital X-ray processing machine.

Hence, a further embodiment of the invention is a method of automatic processing of exposed photographic silver halide X-ray film wherein the imagewise exposed X-ray film is developed in a photographic developer bath comprising a photographic developer, bromide ion, an alkaline material and buffer system to maintain the pH of the developer bath at a desired value, an organic antifoggant and film speed restrainer, and water; the developed X-ray film is fixed, washed and dried; and the developer bath is replenished by replenisher solution to maintain constant the photographic properties of the developer bath during long periods of process or operation in which only small quantities of exposed X-ray film are processed, i.e., under low throughput processing conditions.

DETAILED DISCLOSURE OF THE INVENTION

The processing solution of this invention can be used for both the developer and the replenisher therefor. In the latter embodiment, wherein the replenisher solution has a lower pH than that of the developer, it is only necessary to add a small amount of acid, acetic acid, for example, to adjust the pH. However, for a commercial put-up, a small amount of base (alkaline material) is added to the developer to raise the pH of the developer rather than adding acid to the replenisher to lower its pH. This will be illustrated in Example 1, wherein a small amount of base is added through the starter solution (Part D). The replenisher is added to the developer bath as needed, based on time and/or the amount of film processed, thus compensating for both forms of developer exhaustion. It is surprising that this particular formulation can be used so successfully for low throughput in automatic processors since the differences between it and the prior art are so slight. However, as will be seen in the Examples, the difference in performance between the formulation of this invention and the prior art is very large.

As the photographic developing agents in the processing solution, a combination of 1-phenyl-3-pyrazolidone (sold under the Ilford trademark Phenidone) or a derivative thereof such as 4-methyl or 4,4-dimethyl phenidone, and hydroquinone or a derivative thereof such as chlorohydroquinone or bromohydroquinone is used. This combination is particularly suited for automatic processing of X-ray films. These ordinarily comprise a gelatino-AgBr, AgBrI, or AgClBrI emulsion on a film support such as polyethylene terephthalate.

Any alkaline material may be used to provide the required pH, such as sodium or potassium hydroxide, sodium or potassium carbonate, etc. The buffer system may be any convenient system, e.g., the borate and carbonate buffers conventionally used in X-ray developer baths are both suitable.

The organic antifoggant may be any organic antifoggant and film speed restrainer. Such organic antifoggants are commonly employed in X-ray developer baths and include compounds of the benzimidazole, benzotriazole, benzothiazole, indazole, tetrazole, mercaptotetrazole and thiazole group, as well as anthraquinone sulfonic acid salts. Two or more organic antifoggants may be used. It is preferred to use a mixture of two antifoggants such as 5-nitroindazole and benzotriazole.

A range of bromide ion can be used successfully in this invention and provides excellent stability. 1 to 10 g/liter of KBr, for example, will provide sufficient bromide ion. NaBr may also be employed. Optimum amounts depend on replenishment rate and specific formula.

These essential ingredients, when dissolved in water at the concentrations set forth above, enable the photographic solution of the invention to function as a developer bath and a shelf-stable replenisher.

Other materials may be included in the processing solution, such as gelatin hardening agents, aerial oxidation restrainers, sequestering agents, surfactants, dyes etc., as well known in the art. See, e.g., U.S. Pat. No. 3,545,971 and "Photographic Processing Chemistry", supra, page 149 et seq.

Conventionally, all of the ingredients of the developer are prepared in concentrated form in water. Separate portions of the concentrates are furnished users so that interaction between ingredients is lessened while in this concentrated state. Then, the user makes up the developer solution by measuring various amounts from each part and diluting with water to achieve the desired solution. The pH is then adjusted, e.g., to 10.0±0.3, and the solution charged to the processing tank, e.g., of the type described in U.S. Pat. No. 3,545,971, such as an "X-Omat Processor", in the amount required by the system. Development time is determined empirically or by the processor. Replenishment will be carried out at a rate per unit area of exposed film to provide processing of a large quantity of exposed film without change in sensitometric properties of the film, and will be determined empirically, as is known. As a guide, when using an X-Omat Processor to process X-ray film, a suitable replenishment rate will be about 55 ml per 240 square inches of exposed film for development to normal radiographic density, using the processing solution of the invention.

Some processors have a standby replenishment mode. This works as follows: if no film is passed in a given time, the processor goes into a standby mode which deactivates the drive train and dryer and reduced water supply. After a given time, it comes back on for several minutes and then shuts off again. After a specified number of cycles, it replenishes a predetermined amount. This replenishment is not effective with current developer/replenisher formulations but very effective with this invention since more of the correct replenisher is used.

After development in the processing solution of the invention, the silver halide film is fixed, preferably in an acid fixer, and washed and dried in the usual manner. If a processing machine is used, these steps will be determined by the machine.

The following examples are illustrative of the invention, with Example 1 being the best mode contemplated by the inventor of carrying out the invention.

EXAMPLE 1

The following solutions were prepared in order to formulate a developer/replenisher (I) according to the present invention, and to compare it with a conventional developer/replenisher (II):

| Ingredients | Amt. (g) |
|---|---|
| Part A | |
| Dist. Water | 250 |
| Ethylenediaminetetraacetic Acid (EDTA) | 8 |
| Sodium Bisulfite (43% aq.) | 383 |
| Hydroquinone | 100 |
| KBr | 13 |
| KOH (45% aq.) | 323 |
| $K_2CO_3$ (47% aq.) | 116 |
| Distilled Water to | 1 liter |
| Part B | |
| Acetic Acid | 560 |
| Triethylene Glycol | 240 |
| Phenidone | 60 |
| 5-nitroindazole | 6.4 |
| | 2.66 m moles |
| Benzotriazole | 8.0 |
| Sodium Bisulfite (anhydr.) | 5 |
| Distilled Water to | 1 liter |
| Part C | |
| Dist. Water | 500 |
| Glutaraldehyde (50% aq.) | 300 |
| Sodium Bisulfite (anhydr.) | 106 |
| Water to | 1 liter |
| Part D | |
| Dist. Water | 500 |
| KOH (45% aq.) | 200 |
| KBr | 171 |
| Water to | 1 liter |
| To make developer I: | |
| 250cc A | |
| 25cc B | pH 10.2 |
| 25cc C | |
| Water to | 1 liter |
| 23.4cc D | |
| To make replenisher | |
| 250cc A | pH 10.0 |
| 25cc B | |
| 25cc C | |
| Water to | 1 liter |

For comparison, a conventional high throughput medical X-ray developer II was prepared. The most significant difference was that Part A' (of developer II) contained no KBr, and Part D' contained 130 g acetic acid/liter instead of 200 g KOH 45% aqueous/liter. Developer II had a pH of 10.15, and replenisher II a pH of 10.35 (compared to pH 10.0 for replenisher I).

In an actual hospital situation, samples of exposed, high speed medical X-ray film were processed (ca. 15–20 sheets of 8"×10" film/day) using developers I and II, which were charged to a CRONEX QC-1 Medical X-ray Automatic Processor (E. I. du Pont de Nemours and Company, Wilmington, DE). The respective replenisher solutions were supplied to the replenisher tank thereof. The activities of the systems were checked by processing control strips of X-ray film exposed through a $\sqrt{2}$ 21-step wedge on a Cronex® Electroluminescent (ELS) Sensitometer (E. I. du Pont de Nemours and Company, Wilmington, DE). Two strips per day (one in the morning and one in the afternoon) were processed and the sensitometry checked to see whether the processor and its solutions were performing well. Processing time (dry-to-dry) was about 2½ minutes at 92° F. The processor was equipped with a conventional ammonium thiosulfate fixer solution.

In the case of developer/replenisher II, above, high fog and lower speed was noted after about 2 weeks of use and the machine was shut-down and the solutions drained therefrom. In the case of developer/replenisher I, above, the fog and speed remained constant after more than 4 weeks of continued, low throughput use, demonstrating good long life performance.

EXAMPLE 2

Developer/replenisher I of Example 1 was operated for more than 10½ months at low throughput at St. Joseph's Hospital in Phoenix, Ariz. in a Cronex QC-1 processor under essentially the same conditions as Example 1. The same formula was also run over four weeks at high throughput, thus demonstrating that developer/replenishers of this invention exhibit excellent stability over long periods of time in both high and low throughput.

EXAMPLE 3

In order to differentiate this invention over another prior art developer/replenisher formulation, the example given in Mertz, U.S. Pat. No. 4,046,571 "Processing Solution For Use As Photographic Developer Bath and Replenisher Therefor" (1977), Cols. 3, 4 and 5 was repeated. In this reference, the organic antifoggant and film speed restrainer is defined as being between 7–26 m mole/liter of solution, as compared to 2.66 m mole/liter in Part B of Example 1. Corresponding Part B of the Mertz example containing 3.6 g/liter of 5-chlorobenzotriazole and 5 g/liter of 5-nitrobenzimidazole was difficult to prepare and required heating to ca. 120° F. Preparation of the working strength developer/replenisher as described was also difficult and required constant heating to keep all the solids dissolved. For this reason the solutions could not be tested in a commercial, automatic processor. Instead, control strips of X-ray film were tray processed in this developer and took about 3 times as long to process as those processed in developer solution I of Example 1, above.

EXAMPLE 4

The following solutions were prepared:

| Ingredients | Amt. (g) |
|---|---|
| Part A | |
| Dist. Water | ca. 3785 (1 gal) |
| EDTA | 75 |
| Sodium Bisulfite | 1428 |
| Hydroquinone | 946 |
| KOH (45% aq.) | 3075 |
| KOH (solid) | 1383 |
| Sodium Bicarbonate | 315 |
| KBr | 113 |
| Dist. Water | to 9.46 liters (2.5 gals) |
| Part B | |
| Triethylene Glycol | 402 |
| Acetic Acid | 270 |
| Phenidone | 60 |
| 5-nitroinidazole | 6 |
| Benzotriazole | 8 |
| Dist. Water to | 1 liter |
| Part C | |
| Water | 500 |
| Glutaraldehyde (50% Aq.) | 267 |
| Sodium Bisulfite (anhydr.) | 106 |

-continued

| Ingredients | Amt. (g) |
|---|---|
| Dist. Water to | 1 liter |
| A developer solution was made up as follows: | |
| Dist. Water | 26.5 l. |
| | (7 gal.) |
| NaBr | 120 g |
| Sodium Bisulfite (anhydr.) | 270 g |
| Potassium Carbonate (anhydr.) | 312 g |
| Sodium Carbonate | 200 g |
| Part A, above | 4.75 l. |
| | (5 quarts) |
| Part B, above | .95 l. |
| | (1 quart) |
| Part C, above | .95 l. |
| | (1 quart) |
| Dist. Water | to 37.85 l. |
| | (10 gallons) |
| | pH 10.17 ± 0.05 |

Five gallons (approx. 19 liters) of this developer were charged to the processor described in Example 1. About 60 grams of acetic acid were added to the remaining 19 liters to give a pH of 10.0±0.05 and this was used as the replenisher. The processor was also charged with standard ammonium thiosulfate fixer and set at 92° F. Two samples of exposed X-ray film (high speed CRONEX 4, E. I. du Pont de Nemours and Company), 14×17 inch size, were processed (developed) and the sensitometry of the system checked with control strips as described in Example 1. The processor was then allowed to stand by for the remainder of the day. About 2,000 cc of replenisher was added by the machine during this time. At the end of the 8 hour day, the machine was shutdown. The processor was run for 10 days in this manner. No substantial change was noted in the sensitometry of the control strips used to check developer activity, indicating that this formula was very stable to low throughput of silver halide film and resistant to anerobic and aerobic degradation.

EXAMPLE 5

The formula of Example 2 (pH about 10.2) was used in this example, as both developer and replenisher, in the processor of Example 1. Under low throughput conditions (7 to 10 sheets of X-ray film/day) it served for more than five weeks. At the end of this period of time, control strips processed in this machine showed that the activity of the developer was well within limits and produced excellent results. A conventional developer of the prior art deteriorated badly in less than two weeks under these conditions and required shut-down and cleaning of the automatic processor followed by re-charging with fresh solution.

EXAMPLE 6

A developer/replenisher solution identical to that described in Example 1 was prepared, except that the level of antifoggant was increased to 5.32 m mole per liter (0.32 g/l of 5 nitro-indazole and 0.40 g/l of benzotriazole). All other ingredients and conditions remained the same as described in Example 1. The activity of this solution was checked by processing control strips of medical X-ray photographic film therein. Sensitometric results indicate that this developer will perform satisfactorily under low throughput conditions, i.e., that this solution will remain stable for long periods of nonuse.

EXAMPLE 7

Example 6 was repeated except that the level of antifoggant was raised to 7.0 m mole per liter (0.42 g/l of 5-nitroindazole and 0.53 g/l of benzotriazole). Although film strips processed in this solution were satisfactory as regards sensitometry, solids precipitated from the solution. It was obvious from this fact that it would be impossible to keep this solution in an automatic processor.

EXAMPLES 8, 9 AND 10

A developer/replenisher solution identical to that described in Example 1 was prepared except for the level of antifoggant. Three samples were prepared from this, and the antifoggant changed in each one as follows:

| Example | Antifoggant Level[1] m mole/l | g/l |
|---|---|---|
| 8 | 0.98 | 0.16 |
| 9 | 1.96 | 0.32 |
| 10 | 3.92 | 0.48 |

[1]5-nitroindazole

Film strips processed in these solutions were comparable, sensitometrically, to those processed in the preferred embodiment, indicating that these three levels of antifoggant will perform within this invention.

EXAMPLES 11, 12 AND 13

A developer/replenisher solution identical to that described in Example 1 was prepared, except that the level of antifoggant was changed as follows:

| Example | Antifoggant Level[1] m mole/l | g/l |
|---|---|---|
| 11 | 0.05 | 0.01 |
| 12 | 0.15 | 0.025 |
| 13 | 0.31 | 0.05 |

[2]1-phenyl-5-mercaptotetrazole

Sensitometric results indicate that this developer will perform satisfactorily under low throughput conditions, i.e., that this solution will remain stable for long periods of nonuse.

I claim:

1. A method of automatic processing of exposed photographic silver halide X-ray film wherein the imagewise exposed X-ray film is developed in a photographic developer bath consisting essentially of, per liter: 1-phenyl-3-pyrazolidone (photographic developing agent), 0.8 to 2.5 g, hydroquinone (developing agent, 15 to 35 g, bromide ion, 1 to 7 g, an alkaline material and buffer to maintain the pH of the developer bath at a desired value of 10.0±0.3, an organic antifoggant and film speed restrainer, 0.01 to 6.0 m mole, and water; the developed X-ray film is fixed, washed and dried; and the developer bath is replenished by replenisher solution to maintain constant the photographic properties of the developer bath during long periods of processor operation in which only small quantities of exposed X-ray film are processed; said replenisher solution having a composition within the ranges set forth above but having a pH lower than that of the developer bath.

2. The process of claim 1 wherein the organic antifoggant and film speed restrainer is present in an amount of about 2.66 m moles/liter.

3. The process of claim 1, wherein the organic antifoggant is one or more members selected from the group consisting of a benzimidazole, a benzotriazole, a tetrazole, a thiazole and an anthraquinone sulfonic acid salt.

4. The process of claim 1, wherein the organic antifoggant and film speed restrainer is a mixture of 5-nitroindazole and benzotriazole.

5. The process of claim 1 which contains one or more adjuvants selected from the group consisting of gelatin hardening agents, aerial oxidation restrainers, sequestering agents, surfactants and dyes.

6. The process of claim 1 wherein the pH of the replenisher solution has a lower pH than that of the developer bath due to addition of acid to the replenisher solution to adjust the pH.

7. The process of claim 1 wherein a base by means of a starter solution is added to the developer bath to raise the pH of the developer in comparison with the pH of the replenisher solution.

8. The process according to claim 7 wherein the base is an alkaline material.

* * * * *